US006186434B1

(12) United States Patent
Mitsuhashi

(10) Patent No.: US 6,186,434 B1
(45) Date of Patent: Feb. 13, 2001

(54) TENSION APPARATUS

(75) Inventor: Takashi Mitsuhashi, Kiryu (JP)

(73) Assignee: Ogura Clutch Co., Ltd (JP)

( * ) Notice: Under 35 U.S.C. 154(b), the term of this patent shall be extended for 0 days.

(21) Appl. No.: 09/373,969

(22) Filed: Aug. 13, 1999

(30) Foreign Application Priority Data

Aug. 13, 1998 (JP) ..... 10-228843

(51) Int. Cl.[7] ..... B65H 59/18

(52) U.S. Cl. ..... 242/419.9; 242/147 M; 242/155 M; 364/469.05; 364/472.08; 318/432

(58) Field of Search ..... 242/147 M, 150 M, 242/155 M, 419.9, 419.8, 365.6; 318/432; 364/469.05, 470.1, 472.08

(56) References Cited

U.S. PATENT DOCUMENTS 3,034,744 5/1962 Bancroft .
4,480,799 * 11/1984 Yano et al. ..... 242/419.9 X
4,891,764 * 1/1990 McIntosh ..... 700/183
6,029,923 * 2/2000 Ishimaru et al. ..... 242/419.9

FOREIGN PATENT DOCUMENTS 5-44739 * 2/1993 (JP) ..... 192/21.5
7-37745 2/1995 (JP) .

* cited by examiner

*Primary Examiner*—Michael R. Mansen
(74) *Attorney, Agent, or Firm*—Blakely Sokoloff Taylor & Zafman

(57) ABSTRACT

A tension apparatus includes a mechanical section, signal output section, smoothing circuit, maximum value holding circuit, constant current driving circuit, and discharge circuit. The mechanical section has an electromagnetic brake driven by an exciting current to generate an output torque and applies a tension to a material in continuous form which is being wounded and stretched by the output torque of the electromagnetic brake. The signal output section repeatedly outputs a PWM (Pulse Width Modulation) signal having a duty ratio corresponding to an input tension instruction value before and after a predetermined stop period. The smoothing circuit smoothes the PWM signal from the signal output section. The maximum value holding circuit holds a maximum voltage value of the smoothed PWM signal. The constant current driving circuit supplies an exciting current corresponding to the held maximum voltage value to the electromagnetic brake. The discharge circuit resets holding operation of the maximum value holding circuit on the basis of a magnitude comparison result between a current tension instruction value and a previous tension instruction value.

7 Claims, 3 Drawing Sheets

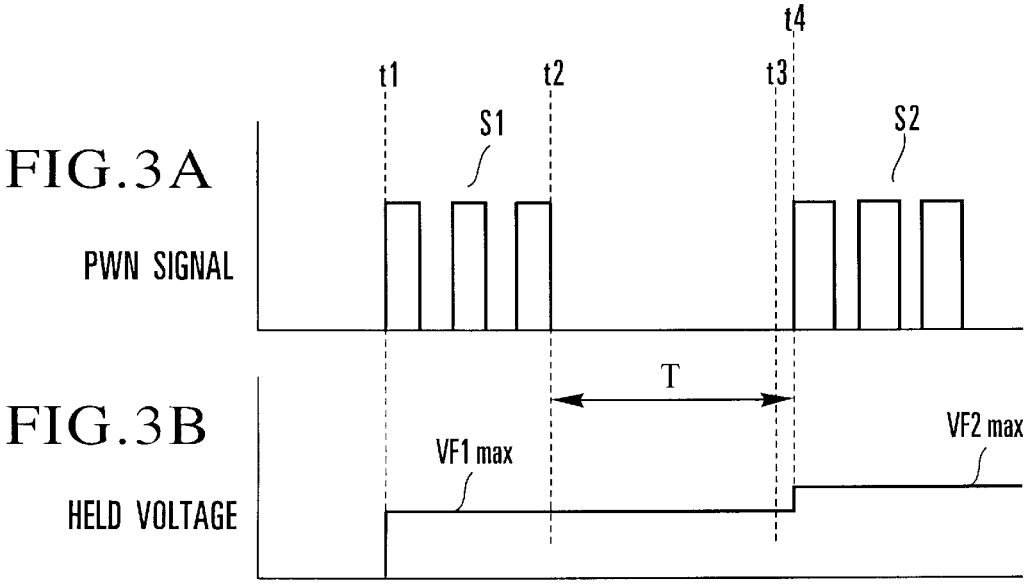
FIG.3A
PWN SIGNAL
t1
t2
t3
t4
S1
S2
FIG.3B
HELD VOLTAGE
T
VF1 max
VF2 max
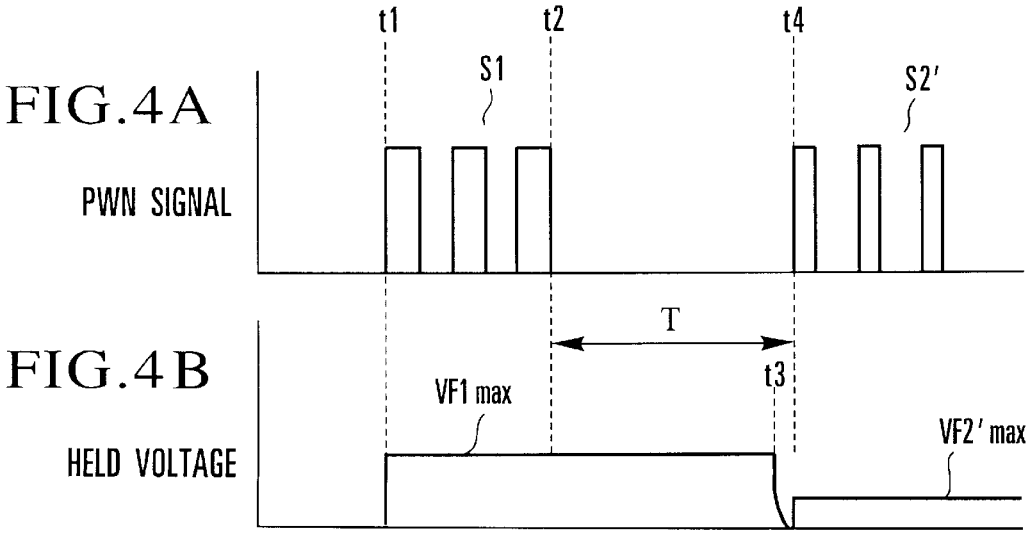
FIG.4A
PWN SIGNAL
t1
t2
t4
S1
S2'
FIG.4B
HELD VOLTAGE
T
t3
VF1 max
VF2' max

TENSION APPARATUS

FIELD OF THE INVENTION

The present invention relates to a tension apparatus having an electromagnetic brake for applying a tension to a material in continuous form such as a fibrous yarn, or a wire or tape of metal material or the like in winding or stretching the material in continuous form.

A tension apparatus used in textile machinery generally comprises an electromagnetic brake actuated as a thread such as a yarn, twist yarn, or double yarn travels, a tension roller fitted on the rotating shaft of the electromagnetic brake, on which a thread is spirally wound, and a pair of large-diameter tenser discs having cooperative surfaces which oppose each other and sandwich the thread between them. A thread handling area is formed from the inlet guide to the outlet guide through the pair of tenser discs and tension roller.

Conventionally, in a tension apparatus of this type, a tension is applied to a material in continuous form such as a thread using a built-in contact or non-contact electromagnetic brake in winding or stretching the material in continuous form. The output torque of the electromagnetic brake is generated in correlation to the exciting current to the electromagnetic brake. A tension based on the product of the output torque of the electromagnetic brake and the radius of the tension roller having the shape of a winding disc or column acts on the material in continuous form. The tension to the material in continuous form is increased/decreased by changing the output torque generated by the electromagnetic brake, i.e., the exciting current to the electromagnetic brake.

This tension apparatus incorporates a D/A converter of a PWM (Pulse Width Modulation) scheme. The D/A converter of the PWM scheme smoothes a PWM signal with a duty ratio corresponding to an input tension instruction value and supplies the PWM signal to a constant current driving circuit. The constant current driving circuit generates an exciting current corresponding to the voltage value of the smoothed PWM signal from the D/A converter and supplies the exciting current to an electromagnetic brake.

According to such a tension apparatus, however, when the PWM signal to the D/A converter is stopped, no voltage is output to the constant current driving circuit. For this reason, the PWM signal to the D/A converter must be continuously output, and a single microcomputer cannot time-divisionally perform PWM control of the electromagnetic brake simultaneously with other communication control or rotation pulse detection processing. Hence, a dedicated PWM controller is required, resulting in an increase in component mounted area or cost of components.

When a microcomputer having a PWM control function capable of independent PWM control is used, the dedicated PWM controller need not be used. However, since the dedicated microcomputer is expensive and cannot be made compact, the component mounted area or cost of components inevitably increases.

SUMMARY OF THE INVENTION

It is an object of the present invention to provide a tension apparatus capable of time-divisionally performing PWM control of an electromagnetic brake together with other communication control or rotation pulse detection processing using a single microcomputer.

In order to achieve the above object, according to the present invention, there is provided a tension apparatus comprising a mechanical section having an electromagnetic brake driven by an exciting current to generate an output torque, the mechanical section applying a tension to a material in continuous form which is being wounded and stretched by the output torque of the electromagnetic brake, signal output means for repeatedly outputting a PWM (Pulse Width Modulation) signal having a duty ratio corresponding to an input tension instruction value before and after a predetermined stop period, smoothing means for smoothing the PWM signal from the signal output means, maximum value holding means for holding a maximum voltage value of the smoothed PWM signal, exciting current supply means for supplying an exciting current corresponding to the held maximum voltage value to the electromagnetic brake, and reset means for resetting holding operation of the maximum value holding means on the basis of a magnitude comparison result between a current tension instruction value and a previous tension instruction value.

BRIEF DESCRIPTION OF THE DRAWINGS

FIG. 3A is a graph showing a PWM signal having a high duty ratio;

FIG. 3B is a graph showing the output voltage from a maximum value holding circuit which has received the PWM signal shown in FIG. 3A;

FIG. 4A is a graph showing a PWM signal having a low duty ratio; and

FIG. 4B is a graph showing the output voltage from the maximum value holding circuit which has received the PWM signal shown in FIG. 4A.

DESCRIPTION OF THE PREFERRED EMBODIMENT

The present invention will be described below in detail with reference to the accompanying drawings.

Figure 1:
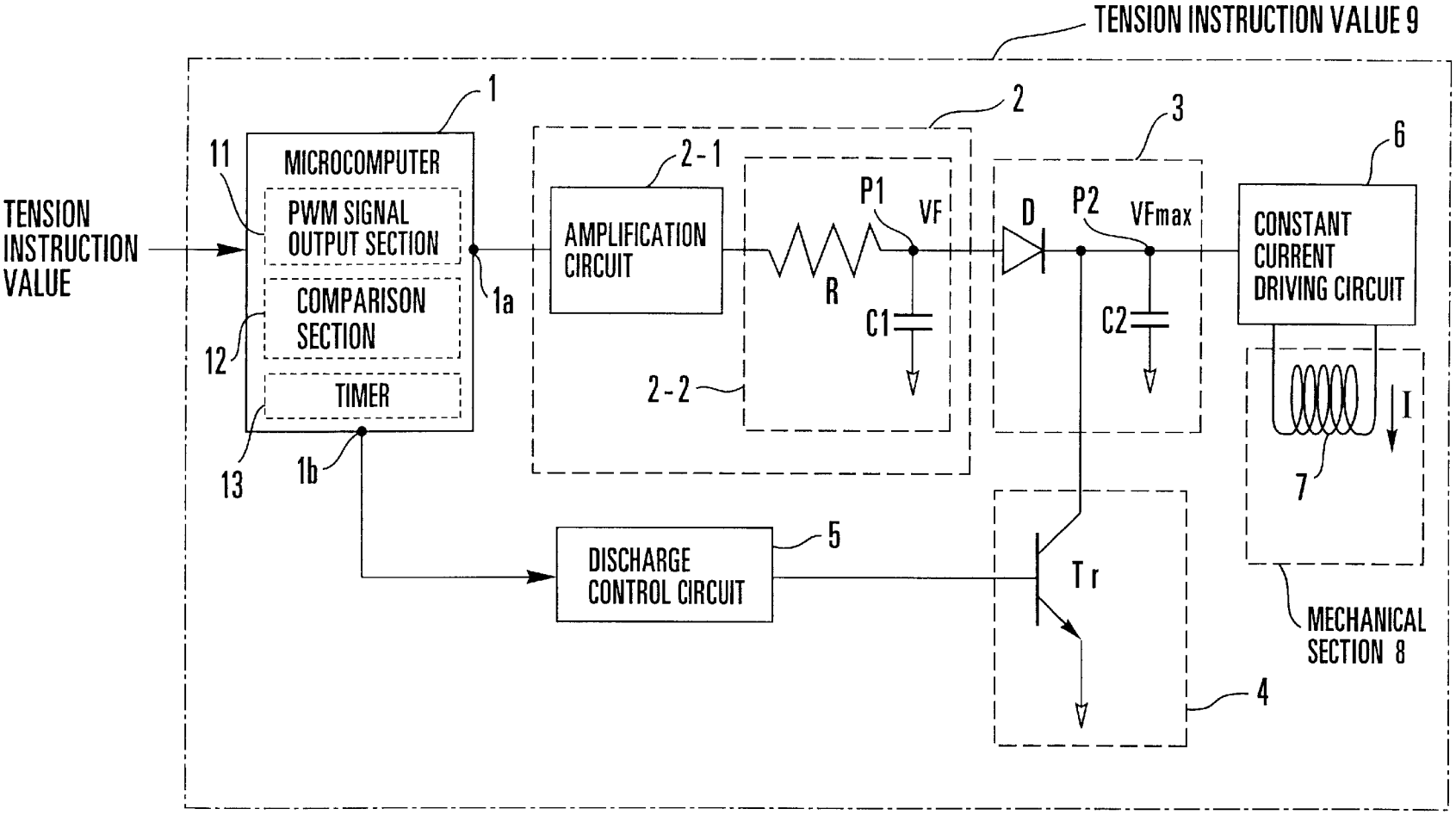
FIG. 1 is a block diagram showing the main part of a tension apparatus according to an embodiment of the present invention.
Figure 2:
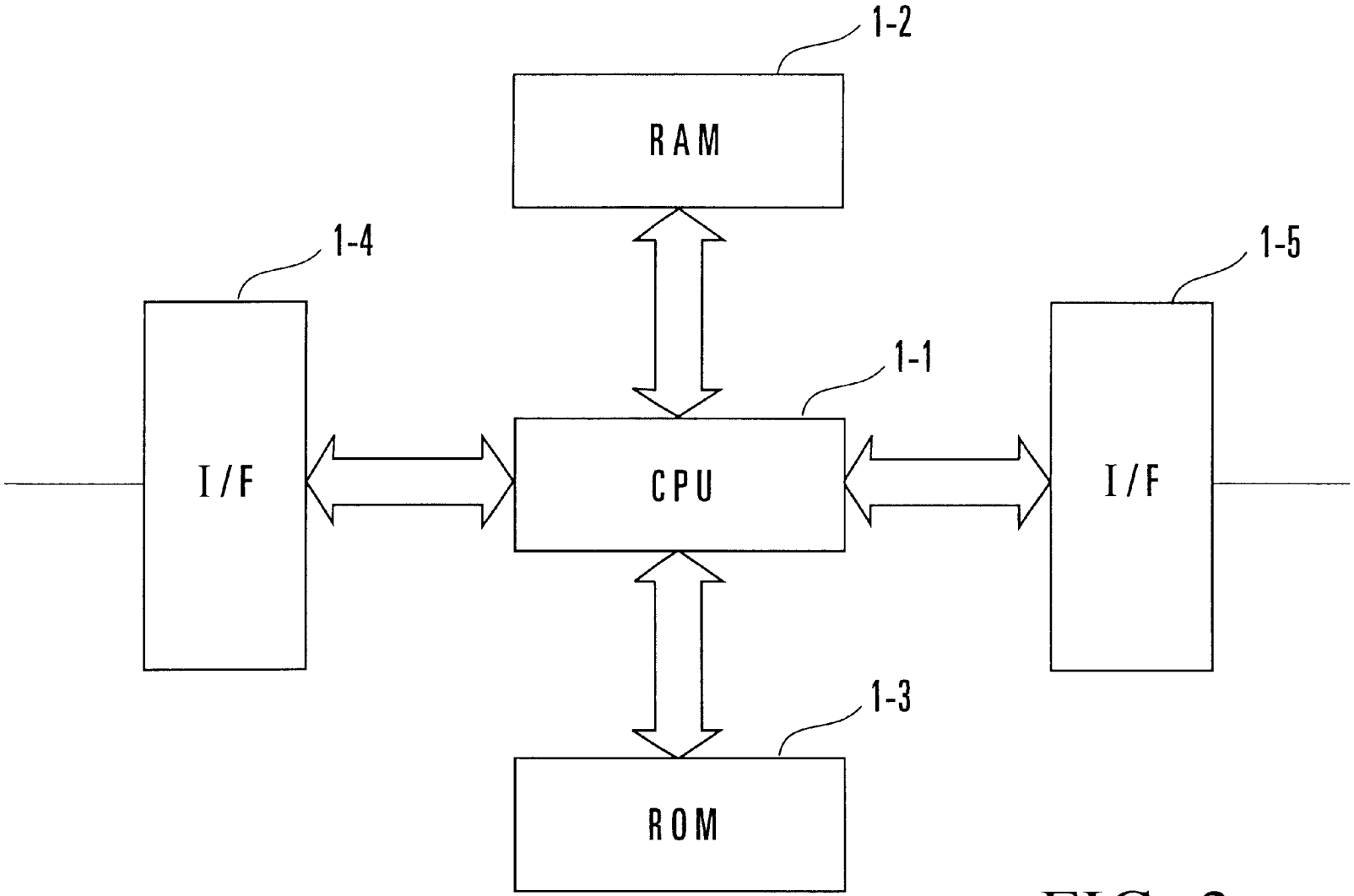
FIG. 2 is a block diagram showing the main part of a microcomputer shown in FIG. 1.

FIG. 1 shows the main part of a tension apparatus according to an embodiment of the present invention. Referring to FIG. 1, a tension apparatus 9 comprises a microcomputer 1 having the functions of a PWM signal output section 11, comparison section 12, and timer 13, a D/A converter 2 of a PWM scheme, which D/A-converts the output from the microcomputer 1, a maximum value holding circuit 3 for holding the maximum value of the output from the D/A converter, a discharge circuit 4 for removing charges held by the maximum value holding circuit 3, a discharge control circuit 5 for controlling the discharge operation of the discharge circuit 4 on the basis of an output from the microcomputer 1, a constant current driving circuit 6 for outputting an exciting current as a constant current in accordance with the output from the D/A converter, and a mechanical section 8 which has an electromagnetic brake 7 driven by the exciting current supplied from the constant current driving circuit 6 and applies a tension to a material in continuous form in accordance with the output torque of the electromagnetic brake 7.

The microcomputer 1 has functional blocks comprising the PWM signal output section 11, comparison section 12, and timer 13. The timer 13 counts a stop period T of the PWM signal and the comparison timing immediately before the stop period T elapses. The PWM signal output section 11 outputs the same PWM signal a plurality of number of times before and after the stop period T counted by the timer 13. The comparison section 12 compares the magnitude of the current tension instruction value with that of the previous tension instruction value at the comparison timing counted by the timer 13.

The microcomputer 1 has a CPU (Central Processing Unit) 1-1 for controlling various sections including the functions of the PWM signal output section 11, comparison section 12, and timer 13 in accordance with a program, a RAM (Random Access Memory) 1-2 for temporarily storing data, and a ROM (Read Only Memory) 1-3 storing a program in advance. Upon obtaining various kinds of input information supplied through an interface 1-4, the microcomputer 1 performs various processing operations in accordance with the program stored in the ROM 1-3 while accessing the RAM 1-2. The various kinds of information in the CPU 1-1 are output through an interface 1-5.

The D/A converter 2 is constructed by an amplification circuit 2-1 and smoothing circuit 2-2. The smoothing circuit 2-2 comprises a resistor R connected in series to the signal line and a capacitor C1 which grounds the output terminal of the resistor R. The maximum value holding circuit 3 comprises a diode D forward-connected in series to the signal line and a capacitor C2 which grounds the cathode of the diode D. The discharge circuit 4 comprises an NPN transistor Tr having a collector connected to the cathode of the diode D, a grounded emitter, and a base connected to the discharge control circuit 5. The discharge control circuit 5 is connected between the microcomputer 1 and the discharge circuit 4.

The mechanical section 8 is constructed by a pulley (tension roller) for winding a material in continuous form, an electromagnetic brake of a hysteresis type for applying a rotational resistance to the pulley, and a pair of tenser discs, as disclosed in U.S. Pat. No. 6,029,923 by the present assignee. For the details of the tension apparatus including the mechanical section 8, the disclosure of U.S. Pat. No. 6,029,923 is incorporated in this specification.

The operation of the tension apparatus 9 will be described next.

A tension instruction value is input from an external tension instruction unit (not shown) to the microcomputer 1 by serial or parallel transmission. Upon receiving the tension instruction value, the PWM signal output section 11 repeatedly outputs a PWM signal having a duty ratio corresponding to the tension instruction value from a port 1*a* before and after the stop period T counted by the timer 13.

The PWM signal from the microcomputer 1 is output to the amplification circuit 2-1 of the D/A converter 2. The amplification circuit 2-1 amplifies the input PWM signal and outputs it to the smoothing circuit 2-2. The smoothing circuit 2-2 smoothes the input PWM signal and outputs a smoothed voltage VF corresponding to the duty ratio of the PWM signal at a connection point P1 between the resistor R and capacitor C1 to the maximum value holding circuit 3.

In the maximum value holding circuit 3 , the smoothed voltage VF from the smoothing circuit 2-2 is supplied to the capacitor C2 through the diode D to charge the capacitor C2. At this time, the transistor Tr of the discharge circuit 4 is kept off, and the diode D prevents the stored charges from reversely flowing to the capacitor C2. The voltage at a connection point P2 between the capacitor C2 and diode D corresponds to a maximum value VFmax of the smoothed voltage VF. The maximum value holding circuit 3 holds the maximum voltage value VFmax even when the smoothed voltage VF from the smoothing circuit 2-2 disappears.

The maximum voltage value VFmax held by the maximum value holding circuit 3 is supplied to the constant current driving circuit 6. The constant current driving circuit 6 generates an exciting current I corresponding to the maximum voltage value VFmax from the maximum value holding circuit 3 and supplies the exciting current to the electromagnetic brake 7.

FIGS. 3A and 3B show the maximum value holding operation for a PWM signal having a high duty ratio.

A PWM signal S1 having a duty ratio corresponding to the previous tension instruction value is output from time t1. When the stop period T from time t2 to time t4 has elapsed, a PWM signal S2 having a duty ratio corresponding to the current tension instruction value is output from the time t4. In this example, as shown in FIG. 3A, since the current tension instruction value is larger than the previous tension instruction value, the duty ratio of the PWM signal S2 is higher than that of the PWM signal S1. That is, the pulse width of the PWM signal S2 is larger than that of the PWM signal S1.

In this case, the D/A converter 2 outputs to the maximum value holding circuit 3 a smoothed voltage VF1 corresponding to the duty ratio of the PWM signal S1 from the microcomputer 1. As shown in FIG. 3B, the maximum value holding circuit 3 holds a maximum value VF1max of the smoothed voltage VF1. The maximum voltage value VF1max is continuously held even after the PWM signal S1 disappears. More specifically, even when the microcomputer 1 stops outputting the PWM signal S1 at time t2, the maximum value holding circuit 3 continuously holds the maximum voltage value VF1max.

The comparison section 12 compares the current tension instruction value with the previous tension instruction value at time t3 immediately before the stop period T of the PWM signal is ended, on the basis of the counting operation of the timer 13. In this case, since the current tension instruction value is larger than the previous tension instruction value, the comparison section 12 does not output a discharge instruction to the discharge control circuit 5.

At time t4 after the stop period T, the PWM signal output section 11 starts outputting the PWM signal S2. The D/A converter 2 outputs to the maximum value holding circuit 3 a smoothed voltage VF2 corresponding to the duty ratio of the PWM signal S2 from the microcomputer 1.

In this case, since the current tension instruction value is larger than the previous tension instruction value, the current smoothed voltage VF2 becomes higher than the previous smoothed voltage VF1. For this reason, the maximum value holding circuit 3 updates the maximum voltage value to a maximum value VF2max of the current smoothed voltage VF2 and holds the maximum voltage value.

FIGS. 4A and 4B show the maximum value holding operation for a PWM signal having a low duty ratio.

In this example, the current tension instruction value is smaller than the previous tension instruction value, and the duty ratio of a PWM signal S2' is lower than that of the PWM signal S1. That is, the pulse width of the PWM signal S2' is smaller than that of the PWM signal S1.

In this case, the D/A converter 2 outputs to the maximum value holding circuit 3 the smoothed voltage VF1 corresponding to the duty ratio of the PWM signal S1 from the microcomputer 1. As shown in FIG. 4B, the maximum value holding circuit 3 holds the maximum value VF1max of the smoothed voltage VF1. The maximum value holding circuit 3 continuously holds the maximum voltage value VF1max even after the PWM signal S1 disappears.

The comparison section 12 compares the current tension instruction value with the previous tension instruction value at the time t3 immediately before the stop period T of the PWM signal is ended, on the basis of the counting operation of the timer 13. In this case, since the current tension instruction value is smaller than the previous tension instruction value, the comparison section 12 issues a discharge instruction to the discharge control circuit 5 through a port 1*b*.

Upon receiving this discharge instruction, the discharge control circuit 5 turns on the transistor Tr of the discharge circuit 4. With this operation, charges stored in the capacitor C2 of the maximum value holding circuit 3 are removed through the transistor Tr to return the voltage (held voltage) at the connection point P2 between the capacitor C2 and the diode D to the ground voltage, i.e., 0 V.

At the time t4 after the stop period T, the PWM signal output section 11 starts outputting the PWM signal S2'. The D/A converter 2 outputs to the maximum value holding circuit 3 a smoothed voltage VF2' corresponding to the duty ratio of the PWM signal S2' from the microcomputer 1. In this case, the voltage held by the maximum value holding circuit 3 has been returned to 0 V. For this reason, the maximum value holding circuit 3 holds the maximum value VF2'max of the smoothed voltage VF2 as the maximum voltage value.

According to this embodiment, since an appropriate output voltage is continuously supplied to the constant current driving circuit 6 even during the stop period T of the PWM signal output from the microcomputer 1, other communication control or rotation pulse detection processing can be performed by the microcomputer 1 even during the stop period T of the PWM signal. For this reason, PWM control of the electromagnetic brake 7 can be time-divisionally performed together with other communication control or rotation pulse detection processing using the single microcomputer 1. Consequently, neither a dedicated PWM controller nor a microcomputer having a PWM control function need be used. In addition, the component mounted area and cost of components can be reduced.

In this embodiment, the comparison function of comparing the current tension instruction value with the previous tension instruction value and the reset function of resetting the maximum voltage value holding operation are constructed by the microcomputer 1. However, the comparison circuit and reset circuit may be discretely constructed.

As has been described above, according to the present invention, since PWM control of the electromagnetic brake can be time-divisionally performed together with other communication control or rotation pulse detection processing using the single microcomputer, neither a dedicated PWM controller nor a microcomputer having a PWM control function need be used. In addition, the component mounted area and cost of components can be reduced.

What is claimed is:

1. A tension apparatus comprising:

a mechanical section having an electromagnetic brake driven by an exciting current to generate an output torque, said mechanical section applying a tension to a material in continuous form which is being wounded and stretched by the output torque of said electromagnetic brake;

signal output means for repeatedly outputting a PWM (Pulse Width Modulation) signal having a duty ratio corresponding to an input tension instruction value before and after a predetermined stop period;

smoothing means for smoothing the PWM signal from said signal output means;

maximum value holding means for holding a maximum voltage value of the smoothed PWM signal;

exciting current supply means for supplying an exciting current corresponding to the held maximum voltage value to said electromagnetic brake; and reset means for resetting holding operation of said maximum value holding means on the basis of a magnitude comparison result between a current tension instruction value and a previous tension instruction value.

2. An apparatus according to claim 1, wherein said apparatus further comprises comparison means for comparing the magnitude of the current tension instruction value with that of the previous tension instruction value, and said reset means performs reset operation when the current tension instruction value is smaller than the previous tension instruction value.

3. An apparatus according to claim 2, wherein said maximum value holding means comprises a capacitor charged by an output from said smoothing means to hold a maximum value, and said reset means comprises a transistor turned on to remove charges stored in said capacitor when the current tension instruction value is smaller than the previous tension instruction value.

4. An apparatus according to claim 3, further comprising a discharge control circuit for turning on said transistor in accordance with a discharge instruction output from said comparison means when the current tension instruction value is smaller than the previous tension instruction value.

5. An apparatus according to claim 2, wherein said signal output means and said comparison means are constructed by a microcomputer.

6. An apparatus according to claim 2, wherein said comparison means performs a tension instruction value comparison operation immediately before the stop period of the PWM signal.

7. An apparatus according to claim 6, wherein said apparatus further comprises timer means for counting the stop period of the PWM signal and a tension instruction value comparison timing, said signal output means starts outputting the PWM signal on the basis of counting operation of said timer means, and said comparison means compares the tension instruction values on the basis of counting operation of said timer means.

* * * * *